United States Patent [19]

Gysling et al.

[11] 4,046,569

[45] Sept. 6, 1977

[54] PHYSICAL DEVELOPMENT OF PD(II) PHOTOSENSITIVE COMPLEXES WITH A LEUCOPHTHALOCYANINE DYE AND A REDUCING AGENT THEREFOR

[75] Inventors: Henry J. Gysling; Mark Lelental, both of Rochester, N.Y.

[73] Assignee: Eastman Kodak Company, Rochester, N.Y.

[21] Appl. No.: 567,668

[22] Filed: Apr. 14, 1975

[51] Int. Cl.[2] ..... G03C 5/24; G03C 1/48; G03C 1/40

[52] U.S. Cl. ..... 96/48 PD; 427/301; 427/343; 427/265; 427/266; 96/76 R; 96/77; 96/88; 106/1

[58] Field of Search ..... 96/76 R, 77, 88, 48 PD; 427/301, 343, 265, 266; 106/1

[56] References Cited

U.S. PATENT DOCUMENTS

| | | | |
|---|---|---|---|
| 2,915,392 | 12/1959 | Pedersen | 96/88 |
| 3,152,903 | 10/1964 | Shepard et al. | 96/64 |
| 3,623,865 | 11/1971 | Case | 96/88 |
| 3,650,748 | 3/1972 | Yudelson et al. | 96/48 PD |
| 3,656,952 | 4/1972 | Miller | 96/48 PD |
| 3,661,587 | 5/1972 | Adrian | 96/48 PD |
| 3,663,225 | 5/1972 | McLeod | 96/48 PD |
| 3,700,448 | 10/1972 | Hillson et al. | 96/88 |
| 3,713,824 | 1/1973 | Manhardt | 96/48 PD |
| 3,719,490 | 3/1973 | Yudelson | 96/88 |
| 3,754,921 | 8/1973 | Riester | 96/88 |
| 3,880,724 | 4/1975 | Gysling | 96/48 PD |

*Primary Examiner*—Won H. Louie, Jr.
*Attorney, Agent, or Firm*—Arthur H. Rosenstein

[57] ABSTRACT

A process for the formation of phthalocyanine dye images employing palladium nuclei to catalyze the reduction of a leucophthalocyanine to the phthalocyanine dye image by a reducing agent.

32 Claims, No Drawings

PHYSICAL DEVELOPMENT OF PD(II) PHOTOSENSITIVE COMPLEXES WITH A LEUCOPHTHALOCYANINE DYE AND A REDUCING AGENT THEREFOR

BACKGROUND OF THE INVENTION

This invention relates to novel photographic processes, elements and physical developer solutions. In a particular aspect it relates to photographic elements containing photosensitive palladium compounds and to processes for the formation of phthalocyanine dye images.

A wide variety of non-silver imaging processes are known in the photographic art. These are, however, generally unit quantum processes and therefore have low speed. High speed photographic processes such as conventional silver halide processes generally use an amplification step. This amplification step is generally autocatalytic in nature.

Processes for the formation of phthalocyanine dye images are known. For example, U.S. Pat. No. 2,915,392 issued Dec. 1, 1959 to Pederson describes a process whereby light activatable reducing agents (photoreductants) are used to reduce leucophthalocyanine dye thereby forming a phthalocyanine dye image. The process of Pederson, however, is necessarily a unit quantum process, that is, one mole of reducing agent must be light activated to obtain one mole of phthalocyanine dye. This results in an inherently slow process requiring long exposure times.

It is known that palladium complexes can be used to form latent image centers for the catalytic deposition of heavy metals from physical developer solutions. This type of process is described for example in Yudelson and Gysling U.S. Pat. No. 3,719,490; Yudelson and Dernbach U.S. Pat. Nos. 3,598,587; and Yudelson and Dernbach U.S. Pat. No. 3,650,748. While these systems are useful, many metals such as silver, copper, and palladium are extremely expensive and it is often desirable to have essentially non-metallic dye images which require no subsequent fix or stabilization steps.

The process of preparing visible metal images from palladium latent images has several disadvantages. These include (1) a relatively slow rate of development, (2) a complexing agent is required in the physical developer and (3) relatively high coverages of expensive palladium complexes are required.

SUMMARY OF THE INVENTION

In accordance with the present invention, we have found that nuclei of palladium will catalyze the reduction of a leucophthalocyanine dye to its phthalocyanine dye counterpart by a reducing agent. The reducing agent can be combined with the leucophthalocyanine dye in a stable physical developer solution. Elements comprising a photosensitive complex, the leucophthalocyanine dye and the reducing agent are also useful in forming phthalocyanine dye images.

In a preferred embodiment of this invention a process for photographic reproduction of images is provided in which catalytic palladium nuclei are formed by the photographic exposure of palladium complexes and in which the resulting latent image is developed by a physical developer bath comprising a leucophthalocyanine dye and a reducing agent. In other embodiments either or both the leucophthalocyanine and the reducing agent can be combined in the photosensitive composition. In these embodiments, development can be accomplished by contacting the element with a solvent containing the component or components not incorporated in the photosensitive composition.

When the leucophthalocyanine dye and/or the reducing agent is incorporated in the photographic element, it is necessary that it be in reactive association with the palladium complex. By "reactive association", it is meant that the reactive components are in the same layer as the palladium complexes and/or in an adjacent layer and/or in a layer that is separated by a layer or layers that are permeable to the reactive components and by-products.

PRACTICE OF THE INVENTION

Any method of producing palladium nuclei is useful in the practice of this invention. Vacuum deposited palladium nuclei alone can serve as catalytic nuclei for the reduction of a leucophthalocyanine dye to its phthalocyanine dye analog.

Numerous light sensitive palladium compounds can be used in the practice of this invention. Palladium complexes which are useful in forming the catalytic nuclei of this invention may be described by the general formula $$[Pd(G)_a(J)_b(K)_c(N)_d]_eM_f \qquad (I)$$

wherein

G, J, K and N are the same or different and may be chosen from the group consisting of:

halide ligands such as bromine, chlorine, or iodine, a carboxylic acid ligand such as a malonate group, an oxalate group, etc., an aromatic ligand such as phenyl, styrene, naphthyl, etc., a nitrogen ligand such as ammonia, an amine such as methylamine, ethylamine, benzylamine, propane diamine, tetraethylenepentamine, aminoethanol, methylaminoethanol, aminonaphthol, bipyridine, phenanthroline, ethylenediaminetetraacetic acid, etc., a nitrile such as nitrilotriethanol, benzonitrile, etc., an imine such as iminodiethanol, an oxime such as salicylaldoxime or an azide such as benzhydrazide, a phosphorous ligand such as triarylphosphine, trialkylphosphine, triarylphosphite etc., an arsenic ligand such as triarylarsine, trialkylarsine, etc., an antimony ligand such as triarylantimony, trialkylantimony, etc., thiocyanate, selenocyanate, tellurocyanate, nitrate, acetate and a sterically hindered polydentate ligand such as tetraethyldiethylenetriamine and the like, M is a counter cation or anion depending on the overall charge of $[Pd(G)_a(J)_b(K)_c(N)_d]$ such as a hydrogen ion, an inorganic acid ion such as a chloride ion, a bromide ion, an iodide ion, a sulfate ion, a nitrate ion, a phosphate ion, etc., an organic acid ion such as an acetate ion, an acrylate ion, oxalate ion, a malonate ion, etc., a metal ion such as a sodium ion, a potassium ion, a calcium ion, a strontium ion, an aluminum ion, etc., an onium ion such as those containing nitrogen, phosphorous or sulfur like a quaternary ammonium ion, a quaternary phosphonium ion, a tertiary sulfonium ion, etc., and the like, M can also be tetraarylborate and, $a$, $b$, $c$ and $d$ are integers from 0 through 4; $a + b + c + d$ is an integer from 1 through 4; $e$ is 1 or 2; and $f$ is an integer from 0 through 8. Typical palladium compounds described above are found in U.S. Pat. No. 3,719,490 to Yudelson which is hereby incorporated by reference.

A particularly useful group of palladium complexes for use with borane type reducing agents contain a bulky organic ligand to provide steric hindrance to spontaneous chemical reduction. Complexes such as tetraarylborates wherein the non-coordinated ligand has intrinsic photosensitivity are also preferred. A comprehensive list of tetraarylborate anions can be found in British Pat. No. 1,246,298 and *Photographic Science and Engineering,* 16, 300 (1972) which are hereby incorporated by references. The useful sterically hindered palladium complexes employing the tetraarylborates are described in *J. Amer. Chem. Society,* 91, 44 (1969) and can be represented by the formula:

$$[Pd(L)_g(X)_h]_iY_j \quad \text{(II)}$$

wherein

L is a sterically hindered polydentate ligand such as a highly substituted tridentate amine, such as tetraethyldiethylenetriamine and tripyridylamine.

X is a univalent anion such as chloride, bromide, azide, thiocyanate, selenocyanate, tellurocyanate, nitrate, acetate and the like; and Y is X or a tetraarylborate;

*g* and *h* are 1 or 2;

*i* is an integer from 1 through 4;

*j* is an integer from 1 through 4; and $g + h$ is at least 2.

The steric hindrance of these compounds allows the use of unusually high concentrations of borane type reducing tape agents in a physical developer solution with no resulting spontaneous reduction of the unexposed complexes by the reducing agent. Some of these complexes can be procesed in a solution which is 6% by weight in dimethylamine borane (DMAB) without fog formation.

The supports, binders, coating compositions, and coating methods as described in the above-mentioned Yudelson patent U.S. Pat. No. 3,719,490 are useful in the practice of this invention.

Suitable porous supports include paper, coated paper porcelain, polymeric films, such as are described hereinafter, on which is coated such porous materials as gelatin, olefinic polymers such as poly(vinyl alcohols), poly(vinyl phthalates), etc., carboxyl containing polymers such as carboxymethyl cellulose, cellulose ether phthalates, cellulose ether succinates, cellulose ether maleates, copolymers of alkyl acrylates with acrylic acid, etc., and the like.

When the palladium compound is coated on a support, it is generally coated with a hydrophilic binder. A solution or dispersion of the palladium compound and binder is formulated, and after thorough mixing it is coated on the support by any well-known coating process such as hopper coating, doctor-blade coating, dip coating, swirl coating, spray coating, etc.

Suitable binders in which the palladium compounds of the present invention can be incorporated include gelatin such as bone gelatin, pigskin gelatin, etc.; olefinic polymers such as poly(vinyl alcohol), poly(vinyl phthalates), etc., carboxyl containing polymers such as carboxymethyl cellulose, cellulose ether phthalates, cellulose ether succinates, cellulose ether maleates, copolymers of alkyl acrylates with acrylic acid, etc., and the like. Non-hydrophilic polymers such as ethyl cellulose can be used in procedures which do not involve imbibition and where the coating composition is a stable dispersion which gives a porous coating upon drying. It is understood that, although many binders may be used herein, the binder should be optically transparent in the region of sensitivity of the complex.

The palladium compound-binder composition can be coated from aqueous solution, or it can be coated from an organic solvent. In some instances, where an organic solvent is employed, the palladium compound-binder composition will form a water-in-oil type dispersion with the organic solvent. Suitable solvents include water immiscible hydrocarbon solvents such as benzene, toluene, etc.; halogenated hydrocarbons such as methylene chloride, ethylene chloride, carbon tetrachloride, etc.; and the like. Mixtures of such solvents can be employed advantageously in the practice of this invention.

In preparing the coating compositions utilizing the palladium compounds disclosed herein useful elements are obtained where palladium is present in an amount equal to at least about 0.005 weight percent of the coating composition. The upper limit in the amount of palladium present can be varied widely. When a binder is employed, palladium is normally present in an amount from about 0.01 weight percent of the coating composition to about 20 weight percent of the coating composition. A preferred weight range for palladium in the coating composition is from about 0.1 weight percent to about 1.0 weight percent.

Coating thicknesses of the palladium compound-binder compositions on a support can vary widely. Normally, a wet coating thickness in the range of about 0.001 inch (0.0025 cm) to about 0.01 inch (0.025 cm) is useful in the practice of the invention. A preferred range of coating thickness is from about 0.002 inch (0.005 cm) to about 0.007 inch (0.018 cm) before drying, although such thicknesses can vary depending upon the particular application contemplated for the element.

Suitable supports for coating the palladium compoundbinder compositions of the present invention include paper, polyethylene-coated paper, glassine, vegetable parchment, polymeric film such as polystyrene film, cellulose nitrate film, cellulose acetate film, cellulose acetate-butyrate film, cellulose acetate-propionate film, poly(ethylene terephthalate)film, poly(ethylene sebacate) film, poly(ethylene adipate) film, etc., and the like. In some embodiments of this invention, a separate support need not be utilized, tne binder acting as the support material.

Elements prepared according to the present invention can be exposed by techniques well known to those skilled in the art of photography. Since the compounds according to this invention exhibit their greatest sensitivity in the blue and near ultraviolet regions, light sources rich in such radiation are preferably employed. These compounds are also sensitive to x-ray and electron beam radiation. Exposure causes the reduction of the palladium compound to nuclei of elemental palladium which act as catalytic centers or sites for the reduction of leucophthalocyanine dye. Depending upon the radiation source and the particular palladium compounds, exposure times of from several seconds to several minutes give satisfactory latent images.

The preferred coverage of the palladium complex is lower when the complexes are used to generate catalytic sites for the formation of phthalocyanine dye than for the deposition of metal from a metal physical developer solution. The coverage of palladium for the purposes of this invention can be a factor 10 less than that necessary for metal deposition. Coverages as low as 0.2 mg of palladium per 0.093 $m^2$ are adequate when using developers to produce phthalocyanine dye images as described herein. The photographic speed will increase with increasing concentration of the light sensitive palladium compound. The preferred coverage is in the range of 1.0 to 2.5 mg of palladium per 0.093 $m^2$.

The leucophthalocyanine dye and/or the reducing agent can be in a separate processing solution or can be included in the photographic element containing the palladium compound. Photographic elements containing leucophthalocyanine dye or reducing agent can be prepared by incorporating these components directly with the coating compositions containing the palladium complexes. Alternatively, the leucophthalocyanine dye and/or the reducing agent may be coated in a separate layer or layers which are in reactive association using suitable coating compositions. When coating leucophthalocyanine dye whether with the palladium complexes or separately it is desirable to use an organic solvent system as most leucophthalocyanine dyes are not water soluble.

When the leucophthalocyanine is coated with a binder, it is normally present in an amount from about 0.5 weight percent of the coating composition to about 10 weight percent of the coating composition.

The above process is negative working. That is, phthalocyanine dye is formed in exposed areas of the element. The process can, however, be employed in a positive working manner in which phthalocyanine is formed in the unexposed areas of the element. In such a process the photosensitive element is exposed in the usual manner and is then contacted with a sheet into which has been imbibed the leucophthalocyanine dye — reducing agent physical developer. In the unexposed areas of the element, palladium complex diffuses to the receiver sheet where it is reduced and catalyzes the reduction of leucophthalocyanine to phthalocyanine dye. Heat may be applied to promote the diffusion of the unexposed palladium complexes. Contact temperatures of from 45° C. to 100° C. are suitable. The image formed on the receiving sheet can be used as such or it can be intensified by immersing the receiver sheet in the dye physical developer bath.

A wide variety of reducing agents are useful in the practice of this invention. Common reducing agents such as hypophosphites, hydrosulfites, borohydrides, cyanoborohydrides, hydrazines and the like can be used.

Typical reducing agents useful in the practice of this invention are, polyhydroxy-substituted aryl compounds such as hydroquinones, catechols and pyrogallols; ascorbic acid derivatives; amino-phenols, p-phenylenediamines, and the like developing agents used in the photographic art. Particular examples of reducing agents for physical developer solutions are 2-methyl-3-chlorohydroquinone, bromohydroquinone, catechol, 5-phenylcatechol, pyrogallol monomethyl ether (1-methoxy-2,3-dihydroxybenzene) and 5-methylpyrogallol monomethyl ether, isoascorbic acid, N-methyl-p-aminophenol, dimethyl-p-phenylenediamine, 4-amino-N,N-di(n-propyl)-aniline and 6-amino-1-ethyl-1,2,3,4-tetrahydroquinoline. Borane type reducing agents can be used to particular advantage with the sterically hindered complexes of formula II. Borane reducing agents useful with these complexes are described in U.S. Patent 3,650,748 to Yudelson et al which is hereby incorporated by reference. These borane reducing agents include amine boranes, phosphine boranes, arsine boranes, stibine boranes, boronium salts and cyanoborohydride ions. A comprehensive list of specific reducing agents is disclosed by Yudelson in col. 2 of the above U.S. Pat. No. 3,650,748.

The useful concentration of the reducing agent in the physical developer or element varies greatly with the characteristics of the other components in the developer or element. With evaporated palladium nuclei for example, the useful concentration range of the reducing agent in a physical developer of the leucophthalocyanine and mild reducing agents such as sodium hypophosphite can be between 1 and 50 grams per liter. In the preferred embodiment where borane type reducing agents are used with sterically hindered palladium complexes the concentration range of the reducing agent can be between 1 and 25 grams per liter. The concentration of the reducing agent is such that the physical developer does not spontaneously reduce either the unexposed palladium complex or the leucophthalocyanine dye. However, the concentration of the reducing agent should be sufficient to reduce the leucophthalocyanine to its phthalocyanine dye analog in the presence of palladium nuclei.

Leucophthalocyanine dyes that are useful according to this invention include those prepared by the chemical oxidation of phthalocyanines and metal phthalocyanines as described in U.S. Pat. Nos. 2,662,895; 2,662,896; 2,662,897; and 2,681,347 and C. J. Pederson, *Journal Organic Chemistry*, 22, 127 (1957). Disclosure of these patents and article is hereby incorporated by reference. Leucophthalocyanines prepared directly by the reaction of phthalonitrile, ammonia and an anhydrous metal salt in a suitable nonaqueous solvent at a temperature below that which results in the formation of the phthalocyanine as described in U.S. Pat. Nos. 2,772,284 and 2,681,348 which are hereby incorporated by reference are also useful. The term leucophthalocyanine as used herein refers to an oxidized derivative of a phthalocyanine or metal phthalocyanine. In general, irrespective of the preparation method, any leucophthalocyanine dye which (1) has suitable solubility in useful solvents such as those described herein, (2) can be chemically reduced to the corresponding insoluble phthalocyanine dye in the presence of a catalyst which is generated by the photodecomposition of a palladium complex, and (3) is not spontaneously reduced by the reducing agent is useful in the practice of the present invention. A useful test for judging the stability of a particular leucophthalocyanine dye to spontaneous reduction in a developer solution is to prepare a saturated alcohol solution of the leucophthalocyanine dye which is also 6% by weight in dimethylamineborane. If the DMAB does not precipitate the phthalocyanine dye spontaneously, the leucophthalocyanine is stable to spontaneous reduction.

The leucophthalocyanine dyes of this invention generally undergo a solubility and/or a color change upon being reduced to their corresponding phthalocyanine dye counterpart. Generally, the phthalocyanines are essentially insoluble in the solvents described herein and highly colored whereas the leucophthalocyanines are moderately soluble and pale in color. The process of this invention can utilize either the solubility change or the color change characteristics of the leucophthalocyanine dye to phthalocyanine dye reduction reaction. In one preferred embodiment, the essentially insoluble phthalocyanine is deposited imagewise in a photographic element from a stable leucophthalocyanine-reducing agent developer bath by the palladium catalyst formed by the imagewise exposure of a palladium complex. In this embodiment, the leucophthalocyanine dye can be colored. In another embodiment, an essentially colorless leucophthalocyanine can be incorporated in a photographic element with the light sensitive palladium complex to form a highly colored phthalocyanine image corresponding to the palladium latent image when the element is processed in a developer solution containing a reducing agent. In still another embodiment, the essentially colorless leucophthalocyanine dye and the reducing agent can be combined in reactive association with the palladium complex in the element. After exposure to form a palladium latent image, treatment of the element with a solvent then causes the catalytic reduction of the leucophthalocyanine dye to the essentially insoluble highly colored, stable phthalocyanine dye image by the reducing agent.

The physical developers useful in the present invention are simple solvent solutions of the leucophthalocyanine dye and/or the reducing agent. The solvent is chosen so that the leucophthalocyanine dye is soluble and the corresponding phthalocyanine dye as well as the palladium complex is insoluble. Useful solvents include alcohols, particularly methanol and ethanol, acetonitrile and dimethyl formamide. The solution can be saturated with leucophthalocyanine dye but is useful with as little as about 0.1% leucophthalocyanine by weight of the solvent.

Physical developer baths can be made from substantially equal volumes of a solution of a leucophthalocyanine and a solution of a reducing agent. The resulting physical developer bath is considered useful if the leucophthalocyanine is not spontaneously reduced to phthalocyanine dye but is reduced to phthalocyanine dye when palladium (0) is added to the bath. By spontaneously, it is meant that the phthalocyanine dye is formed essentially instantaneously without the metal nuclei. It should be understood that the physical developer is useful if it is stable for a time long enough to process the element. Typically, however, physical developer baths of this invention are stable for several days or longer.

For convenience, the temperature of the developer solution can be room temperature (20° C.) although higher or lower temperatures may be used. Solubility considerations for the leucophthalocyanine dye generally determine the lower temperature limit, while the upper temperature limit is the boiling point of the solvent. Since the reduction of leucophthalocyanine dye to phthalocyanine can occur quite rapidly, the actual time and temperature for development are not critical. The phthalocyanine dye is typically formed between 5 and 300 seconds.

The image characteristics such as contrast and speed are determined by the pH of the developer solution. The stability or borane type reducing agents requires a pH above about 7. The useful pH range for a developer containing these reducing agents is between 7 and 13 and the preferred range is between 9 and 12. Generally an increase in pH results in increased contrast and speed of the resulting image. The developer solution can be brought within the desired pH range by the addition of appropriate amounts of suitable basic material such as ammonium hydroxide or sodium hydroxide. Other bases known to those skilled in the art can be substituted for these compounds. The solution can be maintained at the desired pH by incorporating in the solution a suitable buffering system such as a mixture of sodium carbonate and sodium bicarbonate. Other suitable buffering systems will be readily apparent to those skilled in the art.

Palladium ions, in the form of soluble palladium salts or complexes can be added to the physical developer solution to act as an accelerator to development, thereby improving the image tone and increasing the speed. The palladium added in this manner to the developer solution should not be more than about 10% on a molar basis of the leucophthalocyanine, and can be as little as 0.01%. It is understood that the palladium salt or complex added in this manner should be chosen so as not to be spontaneously reduced by the reducing agent in the developer or element.

There can be added to the developer solution a variety of other materials such as preservatives, thickening agents etc. in accordance with usual practice.

The following examples are included for a further understanding of this invention. $Et_4$dien is used to represent 1,1,7,7-tetraethyldiethylenetriamine.

EXAMPLE 1

Nickel leucophthalocyanine was prepared by the tert.butyl hypochlorite oxidation of nickel phthalocyanine in methanol as described in Example 3 of U.S. Pat. 2,662,895. A developer was prepared by mixing equal volumes of a 6% aqueous dimethylamine borane solution and a solution of 0.50 g of the nickel leucophthalocyanine in 100 ml of methanol. Immersion of a microscope slide onto which has been evaporated a series of coverages of palladium nuclei in a step distribution resulted in the amplification of all steps having palladium coverages of $1.2 \times 10^{-8}$g/cm$^2$ or greater to visible blue phthalocyanine dye images.

EXAMPLE 2

This example is a control for Examples 3 and 4.

A sensitized film was prepared by imbibing a 0.5% aqueous solution of $K_2[Pd(C_2O_4)_2]2H_2O$ (pH adjusted to 2.8 with p-toluenesulfonic acid) into poly(vinyl alcohol anthranilatesuccinate) coated poly(ethylene terephthalate) base (hardened with 1% Oxyguar® hardener) as described in Canadian Pat. No. 905,733. After a 15 second exposure to UV radiation (UVL-21 Mineralight 366 nm emission; Ultra-Violet Products, Inc., San Gabriel, Calif.), immersion in the developer described in Example 1 produced uniform blue dye deposition throughout the film.

EXAMPLE 3

Example 2 was repeated with the exception that a fog free negative dye image was obtained using a physical developer consisting of equal volumes of a 2% aqueous sodium hypophosphite solution and a solution of 0.5 g of nickel leucophthalocyanine dissolved in 100 ml of methanol.

EXAMPLE 4

The complex $[Pd(Et_4dien)Cl]\ B(C_6H_5)_4$ was prepared and purified as described in *Journal of the American Chemical Society*, 91, 44 (1969). Paper samples containing this complex were prepared by imbibition of an acetone solution (400 mg complex/15 ml acetone). the diffuse reflectance spectrum of this sensitized paper exhibited absorption maxima at 245 nm and 355 nm.

After a 15 second exposure to UV radiation (UVS-12 Mineralight 254 nm emission) the paper sample was developed to a blue negative image by immersion for 10 seconds in a developer prepared by dissolving 300 mg of the nickel leucophthalocyanine described in Example 1 in a solution of 2 g dimethylamine borane in 100 ml of methanol.

Exposures of the sensitized paper with a monochromator showed that the wavelength of maximum sensitivity was 310 nm.

EXAMPLE 5

A developer solution was prepared by adding 500 mg of the commercially available leucophthalocyanine dye Phthalogen Blue IBN (Farbenfabriken Bayer AG) which is a complex derivative of the trivalent cobalt phthalocyanine to a solution of 2 g of dimethylamine borane in 100 ml of methanol. After a 15 second exposure to UV radiation of the sensitized paper described in Example 4, a blue negative image was obtained after a 5 second immersion in the developer solution. The paper was washed with methanol after development to remove residual soluble Phthalogen Blue IBN.

EXAMPLE 6

The complex $[Pd(Et_4dien)N_3]\ B\ (C_6H_5)_4$ was prepared by adding 1.3 equivalents of $NaN_3$ to an aqueous solution of $[Pd(Et_4dien)Cl]Cl$ prepared as in Example 4 followed by the precipitation of the complex with an aqueous solution of $NaB(C_6H_5)_4$ and recrystallization of the crude product from acetone — water (4:1). Paper stock was then imbibed with a solution of 250 mg of the purified complex in 10 ml of acetone.

Copper leucophthalocyanine was prepared by the chlorine oxidation of copper phthalocyanine suspended in methanol as described in *Journal of Organic Chemistry,* 22 127 (1957). A developer solution was prepared by adding 100 mg of this leucophthalocyanine to a solution of 2 g of dimethylamine borane in 100 ml of methanol. After a 15 second exposure to UV radiation (350 watt Gates lamp), a sensitized paper was developed to a blue fog free negative image by immersion in the above developer solution.

EXAMPLE 7

The complex $[Pd(Et_4dien)SCN]\ B(C_6H_5)_4$ was prepared as described in *Journal of the American Chemical Society,* 91 44 (1969) and sensitized test stock was prepared by imbibing a solution of 250 mg of the recrystallized complex in 10 ml of acetone into paper stock. After a 15 second exposure to UV radiation (350 Watt Gates lamp) the sensitized paper was developed to a blue negative image by immersion in the dye developer described in Example 6.

EXAMPLE 8

The sensitized paper stock described in Example 6 was exposed for 15 seconds to UV radiation (UVS-54 Mineralight hand lamp Ultra-Violet Products, Inc., San Gabriel, Calif.) and developed to a dark blue negative image by immersion for 2 min. in a solution prepared by dissolving 250 mg copper leucophthalocyanine (prepared by reacting anhydrous cupric chloride, ammonia and phthalonitrile as described in British Patent 745,359) in 100 ml methanol and adding to the solution 2 g of DMAB. The reflection density (red filter) of the developed image was 0.77 (background density =0.07).

EXAMPLE 9

This is a comparative example.

An imaging element as described in U.S. Pat. No. 2,915,392 was prepared by successive imbibitions of the copper leucophthalocyanine solution described in Example 8 (250 mg/10 ml acetone) and a mandelic acid solution (250 mg/10 ml water) and then dried. The exposure of Example 8 produced a reflection density of 0.27 with a background density of 0.22.

EXAMPLE 10

The sensitized paper stock described in Example 6 was given a series of electron beam exposures using an accelerating voltage of 10 kV and a beam current of $10^{-7}$ amp. The minimum exposure which could be developed subsequently by the dye developer described in Example 6 corresponds to $1.95 \times 10^{14}$ electrons/cm$^2$.

The process as disclosed herein yields a highly light stable, high resolution phthalocyanine dye image. The process utilizes simple developer solutions and is extremely rapid. As such the process of this invention finds use in a wide variety of applications.

The invention has been described in detail with particular reference to the preferred embodiments thereof, but it will be understood that variations and modifications can be effected within the spirit and scope of the invention.

We claim:

1. A process of preparing phthalocyanine dye image comprising imagewise forming palladium nuclei and catalytically reducing a leucophthalocyanine dye in contact with said palladium nuclei, with a reducing agent that does not spontaneously reduce the leucophthalocyanine dye.

2. A process of preparing a phthalocyanine dye image comprising forming a latent image of palladium nuclei by imagewise exposing to electromagnetic radiation one or more sterically hindered palladium complexes chosen from the group represented by the general formula:

$$[Pd(L)_g(X)_h]_iY_j$$

wherein:

L is a sterically hindered polydentate nitrogen ligand,

X is a univalent anion chosen from the group consisting of chloride, bromide, azide, thiocyanate, selenocyanate, tellurocyanate, nitrate, acetate, Y is X or a tetraarylborate;

$g$ and $h$ are 1 or 2;

$g + h$ is an integer from 2 through 4;

$i$ is an integer from 1 through 4; and $j$ is an integer from 1 through 4;

and catalytically reducing a leucophthalocyanine dye in contact with said palladium nuclei, with a borane reducing agent which does not spontaneously reduce said leucophthalocyanine dye or said palladium complexes said reducing agent being selected from the group consisting of amine boranes, phosphite boranes, arsine boranes, phosphine boranes, stibine boranes, boronium salts and cyanoborohydride ion.

3. A process of preparing a phthalocyanine dye image comprising forming a latent image of palladium nuclei by imagewise exposing to electromagnetic radiation one or more palladium complexes chosen from the group represented by the general formula:

$$[Pd(G)_a(J)_b(K)_c(N)_d]_eM_f$$

ps wherein

G, J, K and N are ligands selected from the group consisting of halogen ligands, carboxylic acid ligands, aromatic ligands, nitrogen ligands, phosphorous ligands and arsenic ligands;

M is selected from the group consisting of ions selected from the group consisting of hydrogen ions, inorganic acid ions, organic acid ions, and metal ions selected from the group consisting of sodium ions, potassium ions, calcium ions, strontium ions and aluminum ions and onium ions;

$a + b + c + d$ is an integer from 1 through 4;

$e$ is 1 or 2; and $f$ is an integer from 0 through 8, and catalytically reducing a leucophthalocyanine dye in contact with said palladium nuclei, with a reducing agent which does not spontaneously reduce said leucophthalocyanine dye or said palladium complexes.

4. The process of claim 2 wherein the leucophthalocyanine dye and the reducing agent are added together in the form of a physical developer solution for a photographic element containing the palladium complex.

5. The process of claim 2 wherein the palladium complex is [Pd(1,1,7,7-tetraethyldiethylenetriamine)Cl]$B(C_6H_5)_4$.

6. The process of claim 2 wherein the palladium complex is [Pd(1,1,7,7-tetraethyldiethylenetriamine)$N_3$]$B(C_6H_5)_4$.

7. The process of claim 2 wherein the palladium complex is imagewise exposed to light in the UV to visible portion of the electromagnetic spectrum to produce the palladium nuclei.

8. The process of claim 2 wherein the palladium complex is imagewise exposed to electron beam energy to produce the palladium nuclei.

9. The process of claim 2 wherein the palladium complex is imagewise exposed to x-ray energy to produce the palladium nuclei.

10. The process of claim 2 wherein the palladium complex is [Pd(1,1,7,7-tetraethyldiethylenetriamine)Cl]$B(C_6H_5)_4$ and the leucophthalocyanine dye is nickel leucophthalocyanine and the reducing agent is dimethylamine borane.

11. The process of claim 4 wherein the physical developer comprises a methanol solution of nickel leucophthalocyanine dye and dimethylamine borane and the photographic element comprises the palladium complex [Pd(1,1,7,7-tetraethyldiethylenetriamine)Cl]$B(C_6H_5)_4$.

12. A photographic element comprising a photosensitive layer comprising one or more palladium complexes said complexes being capable of forming palladium nuclei on exposure to electromagnetic radiation, a layer comprising a leucophthalocyanine dye and a layer containing a reducing agent which does not spontaneously reduce said leucophthalocyanine dye or said palladium complexes and being capable of reducing said leucophthalocyanine dye to phthalocyanine dye in the presence of said palladium nuclei, said layers being in reactive association with one another.

13. The photographic element of claim 12 wherein the pallidium complexes are chosen from the group represented by the general formula:

$$Pd(L)_g(X)_h]_iY_j$$

wherein

L is a sterically hindered polydentate nitrogen ligand,

X is a univalent anion chosen from the group consisting of chloride, bromide, azide, thiocyanate, selenocyanate, tellurocyanate, nitrate, acetate;

Y is X or a tetraarylborate;

$g$ and $h$ are 1 or 2;

$i$ is an integer from 1 through 4;

$j$ is an integer from 1 through 4; and $g + h$ is at least 2;

and the reducing agent is selected from the group consisting of amine boranes and phosphite boranes.

14. The photographic element of claim 12 where the palladium complexes, the leucophthalocyanine dye and the reducing agent are present in the same layer.

15. The photographic element of claim 12 where the palladium complex is [Pd(1,1,7,7-tetraethyldiethylenetriamine) Cl]$B(C_6H_5)_4$.

16. The photographic element of claim 13 where the palladium complex is [Pd(1,1,7,7-tetraethyldiethylenetriamine) $N_3$]$B(C_6H_5)_4$.

17. The photographic element of claim 13 where the leucophthalocyanine dye is nickel leucophthalocyanine.

18. The photographic element of claim 13 where the reducing agent is dimethylamine borane.

19. The photographic element of claim 13 where the palladium complex is [Pd(1,1,7,7-tetraethyldiethylenetriamine) Cl]$B(C_6H_5)_4$ and the leucophthalocyanine dye is nickel leucophthalocyanine and the reducing agent is dimethylamine borane.

20. A photographic element comprising a photosensitive layer comprising one or more palladium complexes said complexes being capable of forming palladium nuclei on exposure to electromagnetic radiation, and a layer comprising a leucophthalocyanine dye, said layers being in reactive association with one another.

21. The photographic element of claim 20 wherein the palladium complexes are chosen from the group represented by the general formula:

$$Pd(G)_a(J)_b(K)_c(N)_d]_eM_f$$

wherein

G, J, K and N are ligands selected from the group consisting of halogen ligands, carboxylic acid ligands, aromatic ligands, nitrogen ligands, phosphorous ligands and arsenic ligands;

M is selected from the group consisting of ions selected from the group consisting of hydrogen ions, inorganic acid ions, organic acid ions, and metal ions selected from the group consisting of sodium ions, potassium ions, calcium ions, strontium ions and aluminum ions and onium ions;

$a, b, c, d$ are integers from 0 through 4 and $a + b + c + d$ is an integer from 1 through 4;

$e$ is 1 or 2; and

$f$ is an integer from 0 through 8.

22. The photographic element of claim 20 wherein the palladium complexes are chosen from the group represented by the general formula:

$$[Pd(L)_g(X)_h]_iY_j$$

wherein

L is a sterically hindered polydentate nitrogen ligand;

X is a univalent anion chosen from the group consisting of chloride, bromide, azide, thiocyanate, selenocyanate, tellurocyanate, nitrate, acetate;

Y is X or a tetraarylborate;

$g$ and $h$ are 1 or 2;

$g + h$ is at least 2;

$i$ is an integer from 1 through 4; and $j$ is an integer from 1 through 4.

23. The photographic element of claim 20 where the palladium complex and the leucophthalocyanine dye are in the same layer.

24. The photographic element of claim 23 where the palladium complex is [Pd(1,1,7,7-tetraethyldiethylenetriamine) Cl]$B(C_6H_5)_4$.

25. The photographic element of claim 23 where the palladium complex is [Pd(1,1,7,7-tetraethyldiethylenetriamine) $N_3$]$B(C_6H_5)_4$.

26. The photographic element of claim 23 where the leucophthalocyanine dye is nickel leucophthalocyanine.

27. The photographic element of claim 23 where the palladium complex is [Pd(1,1,7,7-tetraethyldiethylenetriamine) Cl]$B(C_6H_5)_4$ and the leucophthalocyanine dye is nickel leucophthalocyanine.

28. A photographic element comprising a photosensitive layer comprising one or more palladium complexes capable of forming palladium nuclei on exposure to electromagnetic radiation, said; palladium complexes are chosen from the group represented by the general formula:

$$[Pd(L)_g(X)_h]_iY_j$$

wherein;

L is a sterically hindered polydentate nitrogen ligand,

X is a univalent anion chosen from the group consisting of chloride, bromide, azide, thiocyante, selenocyanate, tellurocyanate, nitrate, acetate;

Y is X or a tetraarylborate;

i g and $h$ are 1 or 2;

$g + h$ is at least 2;

$i$ is an integer from 1 through 4; and $j$ is an integer from 1 through 4; and a layer comprising a reducing agent which does not spontaneously reduce said palladium complexes and being capable of reducing a leucophthalocyanine dye to phthalocyanine dye in contact with said palladium nuclei, said reducing agent is chosen from the group consisting of amine boranes, phosphine boranes, arsine boranes, phosphite boranes, stibine boranes, boronium salts and cyanoborohydride ion, said layers being in reactive association with one another.

29. The photographic element of claim 28 where the palladium complexes and the reducing agent are in the same layer.

30. The photographic element of claim 28 where the palladium complex is [Pd(1,1,7,7-tetraethyldiethylenetriamine) Cl]$B(C_6H_5)_4$.

31. The photographic element of claim 28 where the reducing agent is dimethylamine borane.

32. The photographic element of claim 12 wherein the palladium complexes are chosen from the group represented by the general formula:

$$[Pd(G)_a(J)_b(K)_c(N)_d]_eM_f$$

wherein

G, J, K and N are ligands selected from the group consisting of halogen ligands, carboxylic acid ligands, aromatic ligands, nitrogen ligands, phosphorous ligands and arsenic ligands;

M is selected from the group consisting of ions selected from the group consisting of hydrogen ions, inorganic acid ions, organic acid ions, and metal ions selected from the group consisting of sodium ions, potassium ion, calcium ions, strontium ions and aluminum ions and onium ions;

$a, b, c, d$ are integers from 0 through 4;

$a + b + c + d$ is an integer from 1 through 4;

$e$ is 1 or 2; and $f$ is an integer from 0 through 8.

* * * * *